US008113274B2

(12) United States Patent
Rivas et al.

(10) Patent No.: US 8,113,274 B2
(45) Date of Patent: Feb. 14, 2012

(54) ELECTRIC SUBMERSIBLE PUMPING SYSTEM WITH GAS VENT

(75) Inventors: Olegario Rivas, Tulsa, OK (US); Patricia A. Kallas, Sand Springs, OK (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/024,571

(22) Filed: Feb. 10, 2011

(65) Prior Publication Data

US 2011/0132595 A1 Jun. 9, 2011

Related U.S. Application Data

(62) Division of application No. 12/718,005, filed on Mar. 5, 2010, now abandoned, which is a division of application No. 11/696,315, filed on Apr. 4, 2007, now Pat. No. 7,673,676.

(51) Int. Cl.
*E21B 43/38* (2006.01)
*E21B 43/12* (2006.01)

(52) U.S. Cl. ..... 166/106; 166/105.5; 166/265; 166/370; 166/372; 417/109

(58) Field of Classification Search ..... 166/105.5, 166/105.6, 106, 372, 370, 265; 417/109, 417/111

See application file for complete search history.

(56) References Cited

U.S. PATENT DOCUMENTS

| | | | | |
|---|---|---|---|---|
| 3,625,288 | A | 12/1971 | Roeder | |
| 3,974,878 | A | 8/1976 | Hardy et al. | |
| 4,589,482 | A * | 5/1986 | Bayh, III | 166/105.5 |
| 4,632,184 | A | 12/1986 | Renfroe et al. | |
| 5,657,821 | A | 8/1997 | Beauquin et al. | |
| 5,947,206 | A | 9/1999 | McCalvin et al. | |
| 6,179,056 | B1 | 1/2001 | Smith | |
| 6,357,530 | B1 * | 3/2002 | Kennedy et al. | 166/369 |
| 6,533,039 | B2 | 3/2003 | Rivas | |
| 6,651,740 | B2 | 11/2003 | Kobylinski | |
| 6,702,015 | B2 | 3/2004 | Fielder | |
| 7,506,690 | B2 * | 3/2009 | Kelley | 166/372 |
| 2003/0145989 | A1 | 8/2003 | Shaw | |

FOREIGN PATENT DOCUMENTS

| | | |
|---|---|---|
| GB | 2342670 | 4/2000 |
| GB | 2371062 | 7/2002 |

* cited by examiner

*Primary Examiner* — Giovanna Wright
(74) *Attorney, Agent, or Firm* — Robert Van Someren

(57) ABSTRACT

A technique is provided for pumping fluids from a wellbore. An electric submersible pumping system is deployed in a wellbore on a tubing. Free gas can potentially accumulate around the electric submersible pumping system, but a gas vent is positioned to remove free gas.

16 Claims, 4 Drawing Sheets

ELECTRIC SUBMERSIBLE PUMPING SYSTEM WITH GAS VENT

CROSS-REFERENCE TO RELATED APPLICATIONS

This application is a Divisional U.S. application Ser. No. 12/718,005, filed Mar. 5, 2010, entitled "Electric Submersible Pumping System With Gas Vent" which is a divisional of U.S. application Ser. No. 11/696,315, filed Apr. 4, 2007, now U.S. Pat. No. 7,673,676 incorporated herein.

BACKGROUND

Well completions are used in a variety of well related applications involving, for example, the production of fluids. A wellbore is drilled into a geological formation, and a completion is deployed into the wellbore by tubing or other deployment mechanisms. Generally, the wellbore is drilled through one or more formations containing desirable production fluids, such as hydrocarbon based fluids.

In many of these applications, electric submersible pumping systems are used to pump fluid from the wellbore to a collection location. However, the formation of free gas at the pump intake of the electric submersible pumping system can severely degrade pumping system performance. In some environments, a gas lock condition can result in which the pump is unable to deliver enough pressure to keep the pumping action continuous.

When a packer is used above the electric submersible pumping system, free gas can accumulate below the packer and eventually create a gas pocket that reaches the pump intake and triggers the gas lock condition. Attempts have been made to evacuate the gas accumulated below the packer, but these attempts have met with limited success. Without sufficient removal of the accumulated gas, the submersible pump of the electric submersible pumping system can be exposed to free gas which reduces pumping efficiency and increases the possibility of reaching the gas lock condition.

SUMMARY

In general, the present invention provides a system and method for pumping fluids from a wellbore. An electric submersible pumping system is deployed into a wellbore on a tubing. Free gas can accumulate around the electric submersible pumping system, but a gas vent is positioned to remove the free gas.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to completions that can be used in subterranean environments to move fluids to a desired location. The completions generally comprise electric submersible pumping systems deployed on tubing, such as production tubing or coiled tubing. The tubing can be utilized as a flow path for fluids produced by the electric submersible pumping system and pumped to a desired collection location. The completions also generally comprise at least one packer positioned to form a seal between the tubing and the surrounding wellbore wall which can be in the form of a wellbore casing. In environments in which the well fluids have a relatively high gas-to-liquid ratio, e.g. 20% or more, the gas can interfere with the pumping efficiency of the electric submersible pumping system. Furthermore, free gas that is separated as well fluid is drawn into a pump intake or that is separated by virtue of a gas separator, collects beneath the packer. One or more gas vents are positioned to remove the accumulated free gas so as not to create a gas lock condition or otherwise interfere with operation of the electric submersible pumping system.

Figure 1:
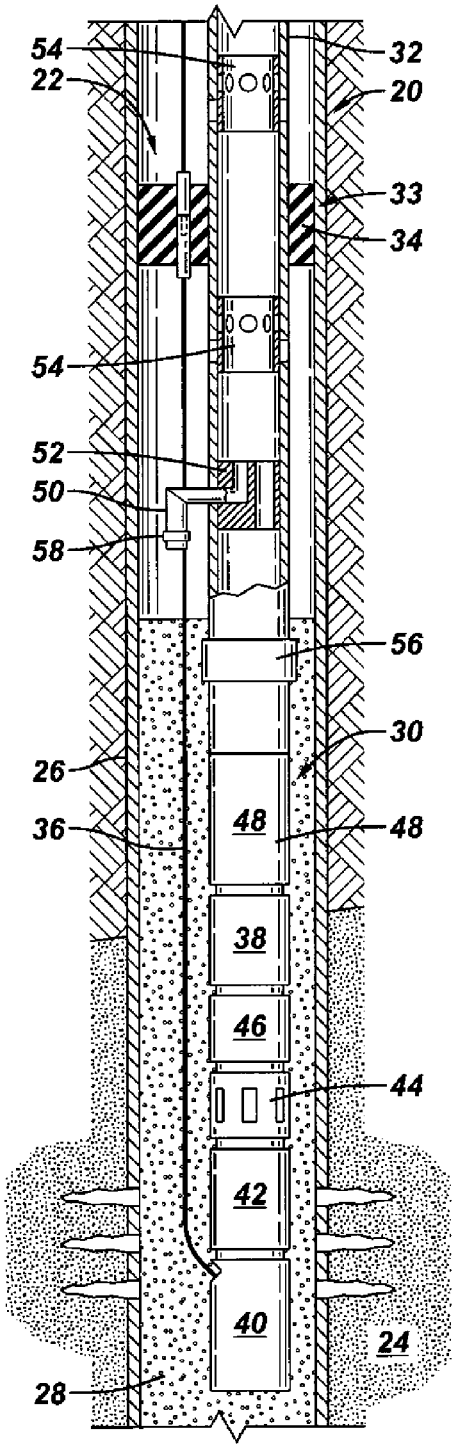
FIG. 1 is a front elevation view of a completion deployed in a wellbore and having a gas vent positioned to remove accumulated gas, according to an embodiment of the present invention.

Referring generally to FIG. 1, one embodiment of a completion 20 deployed in a wellbore 22 is illustrated. The wellbore 22 is drilled into a subsurface formation 24 and may be lined with a casing 26. The casing 26 typically is perforated to allow flow of well fluids 28 between formation 24 and wellbore 22.

In the embodiment illustrated, completion 20 comprises an electric submersible pumping system 30 deployed on a tubing 32, such as a production tubing or coiled tubing. The tubing 32 extends through an isolation device 33, e.g. a packer 34, which isolates the electric submersible pumping system in wellbore 22. In the embodiment illustrated, packer 34 forms a seal between tubing 32 and the surrounding wellbore, e.g. casing 26, to seal off a desired region of wellbore 22. A power cable 36 also is routed through packer 34 for connection with electric submersible pumping system 30 to provide power for operation of the submersible pumping system.

Many types of electric submersible pumping systems 30 may be utilized depending on the environment, wellbore depth, fluid type, and other factors. In the example illustrated in FIG. 1, electric submersible pumping system 30 comprises a submersible pump 38 which may be a centrifugal style pump. Submersible pump 38 is powered by a submersible motor 40 supplied with electrical power via power cable 36. Submersible motor 40 drives submersible pump 38 through a motor protector 42, and submersible pump 38 draws well fluid into the electric submersible pumping system through a pump intake 44. Pumping system 30 also may comprise a variety of other components, such as a gas-oil separator 46 and an outlet section 48 by which submersible pumping system 30 is coupled to tubing 32.

Gas collecting beneath packer 34 is removed through a gas vent in the form of a gas inlet 50 typically positioned below packer 34 and above electric submersible pumping system 30. In the embodiment illustrated, gas inlet 50 extends through the wall of tubing 32 and into a landing profile 52. The landing profile 52 allows pumped fluids to be conveyed around the landing profile without commingling with free gas entering through gas inlet 50.

Completion 20 also may comprise a variety of other features. For example, one or more sliding sleeves 54 may be positioned along tubing 32. In the embodiment illustrated, one sliding sleeve 54 is positioned above packer 34 and another sliding sleeve 54 is positioned beneath packer 34. In some applications, completion 20 also may comprise subsurface safety valves to enable shutting down of the well in case of emergency. For example, a subsurface safety valve 56 may be installed along tubing 32 between electric submersible pumping system 30 and landing profile 52 to stop, if necessary, the flow of fluid pumped by the electric submersible pumping system into tubing 32. By way of further example, another subsurface safety valve 58 can be installed in gas inlet 50 to stop the flow of free gas into landing profile 52, if necessary. This combination of subsurface safety valves allows the entire well to be shut off in case of an emergency.

Figure 2:
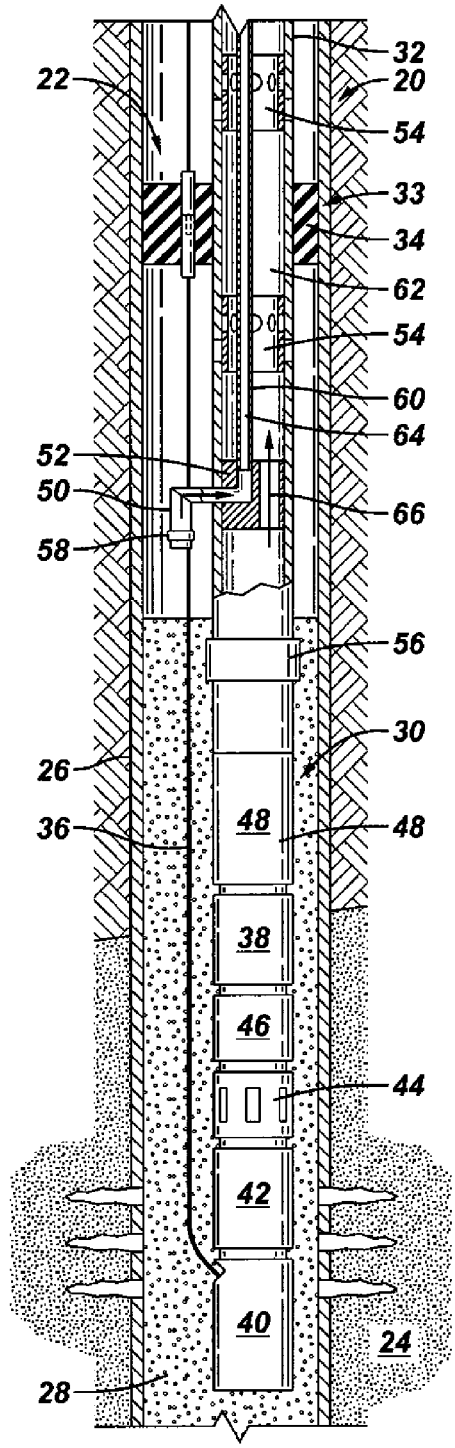
FIG. 2 is a front elevation view similar to that of FIG. 1 but showing an example of a gas removal flow path, according to an embodiment of the present invention.

Landing profile 52 enables the formation of at least two separate flow paths within tubing 32 so that pumped fluid and free gas can be separately produced to surface locations or other suitable locations, as illustrated in FIG. 2. In this embodiment, a second tubing 60 is landed in landing profile 52 and extends upwardly through tubing 32 to a surface location. Second tubing 60 creates a first flow path 62, located between second tubing 60 and the surrounding tubing 32, and a second flow path 64 within the interior of second tubing 60. By way of example, second tubing 60 may be concentrically located within tubing 32. Furthermore, second tubing 60 may comprise coiled tubing or other suitable tubing. In one embodiment, tubing 32 comprises production tubing, and second tubing 60 comprises coiled tubing deployed along the interior of tubing 32.

In the embodiment illustrated in FIG. 2, gas inlet 50 is coupled in fluid communication with second tubing 60 and second flow path 64. Accordingly, free gas that accumulates beneath packer 34 flows into gas inlet 50, through the side wall of tubing 32, through landing profile 52, and into second tubing 60 for routing to the surface or other collection location along second flow path 64. Simultaneously, fluid produced by electric submersible pumping system 30 bypasses landing profile 52, as indicated by arrow 66. The fluid produced by electric submersible pumping system 30 is produced upwardly along first flow path 62 in the space between the exterior surface of second tubing 60 and the interior surface of tubing 32.

Figure 3:
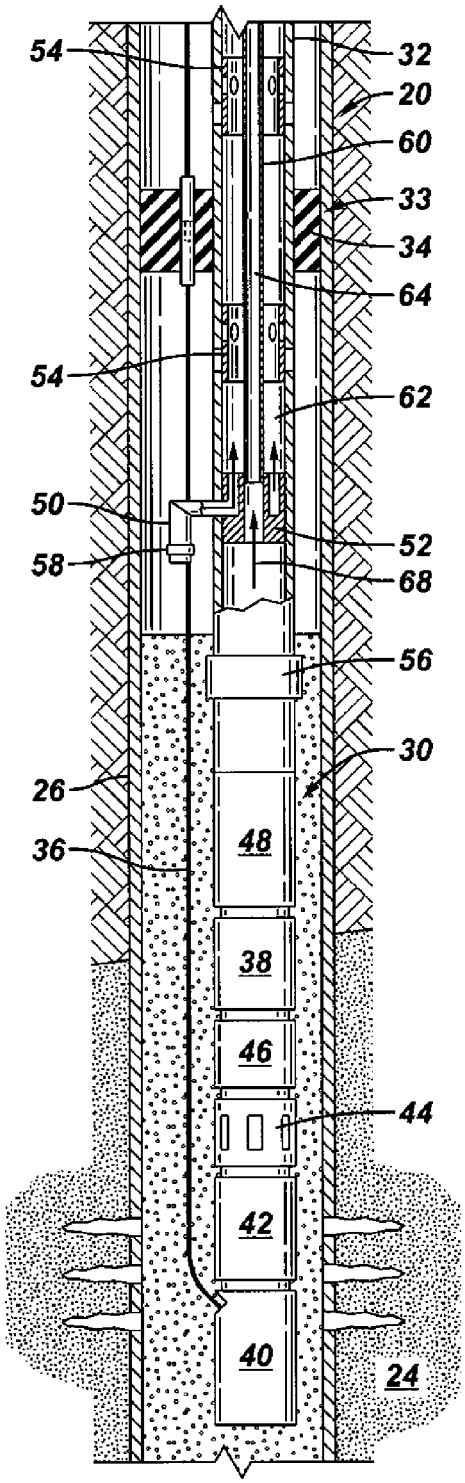
FIG. 3 is a front elevation view similar to that of FIG. 1 but showing an alternate gas removal flow path, according to another embodiment of the present invention.

In an alternate embodiment, the free gas is produced along first flow path 62, and fluid pumped by electric submersible pumping system 30 is produced along second flow path 64, as illustrated in FIG. 3. In this alternate embodiment, landing profile 52 is configured to direct gas entering gas inlet 50 into the space between second tubing 60 and surrounding tubing 32. Correspondingly, landing profile 52 is configured such that fluid produced by pumping system 30 is produced directly through landing profile 52 and into second tubing 60, as indicated by arrow 68. The fluid produced by electric submersible pumping system 30 travels along second flow path 64 separated from the free gas produced along first flow path 62.

Figure 4:
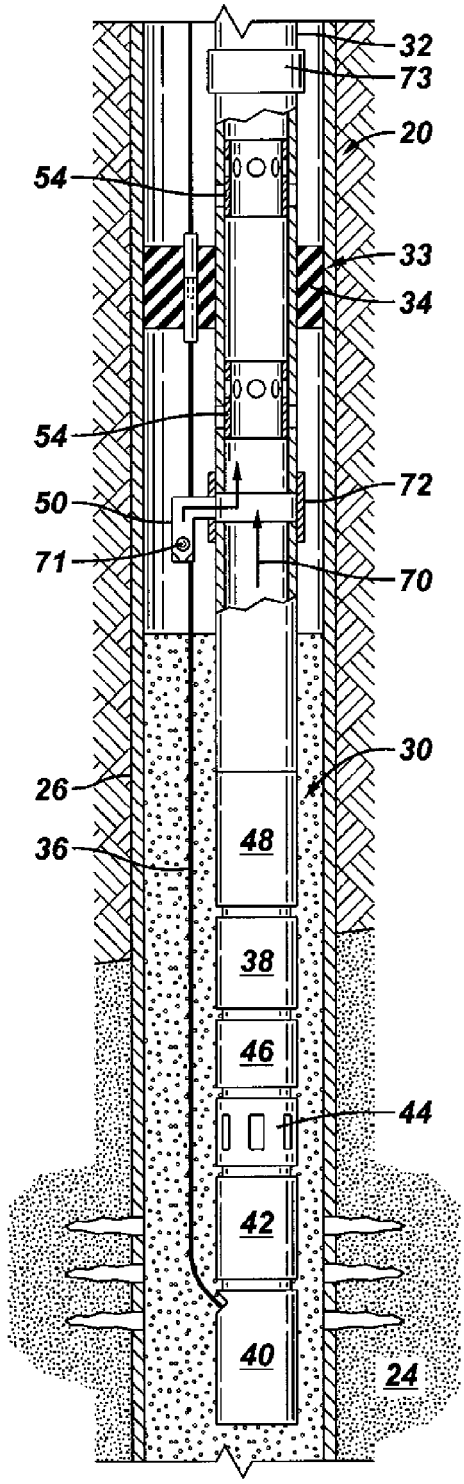
FIG. 4 is a front elevation view of a completion deployed in a wellbore that illustrates another example of a gas vent, according to an alternate embodiment of the present invention.

Other embodiments of gas vents, e.g. gas inlets, can be utilized to remove free gas accumulated beneath packer 34. As illustrated in FIG. 4, for example, gas inlet 50 is connected directly into a primary flow path 70 along the interior of tubing 32. A check valve 71 blocks any discharge of pumped fluid into the annulus surrounding tubing 32 while enabling the flow of free gas from below packer 34 and into tubing 32. The free gas and pumped fluid are commingled for production to a surface location or other collection location. In this embodiment, gas inlet 50 and check valve 71 may be formed as part of a tubing joint 72 positioned in production tubing 32. A subsurface safety valve 73 may be positioned above packer 34. This style of completion is amenable to, for example, shallow packer applications.

Figure 5:
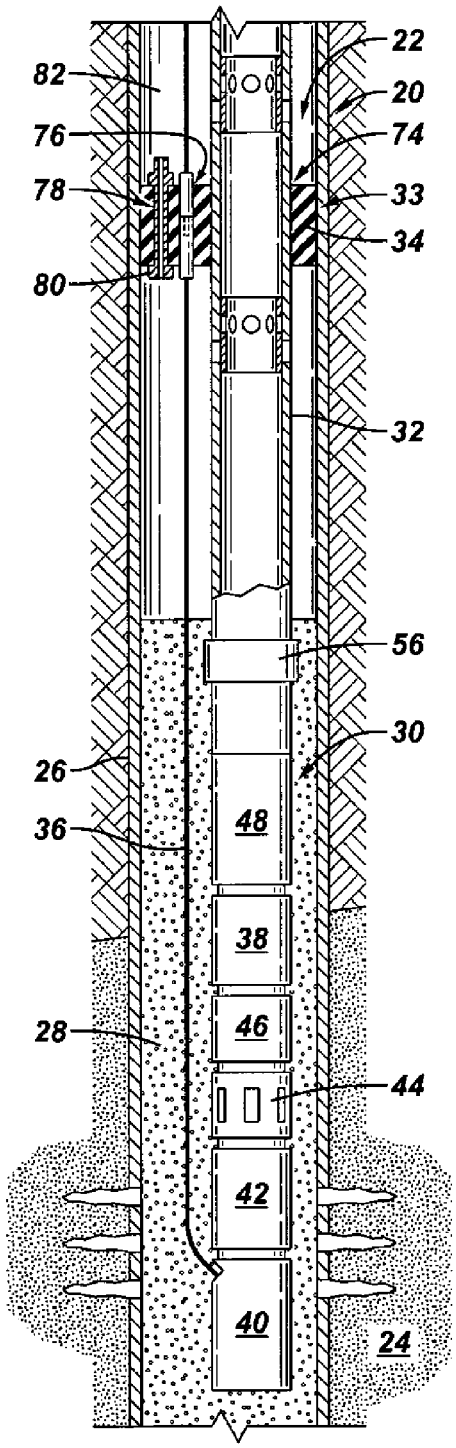
FIG. 5 is a front elevation view of a completion deployed in a wellbore that illustrates another example of a gas vent, according to an alternate embodiment of the present invention.

Another alternate embodiment is illustrated in FIG. 5. In this embodiment, packer 34 comprises at least three separate pass-through passages 74, 76 and 78. Pass-through passage 74 accommodates the passage of tubing 32 therethrough, and pass-through passage 76 accommodates the passage of power cable 36 therethrough. Pass-through passage 78, however, is designed to receive a gas vent valve 80 positioned to vent free gas from a position of accumulation beneath packer 34 to an annulus region 82 above packer 34. Once above packer 34, the free gas can flow to the surface. An individual gas vent valve 80 or a plurality of gas vent valves 80 can be used to facilitate removal of the pocket of gas that potentially accumulates beneath packer 34.

Figure 6:
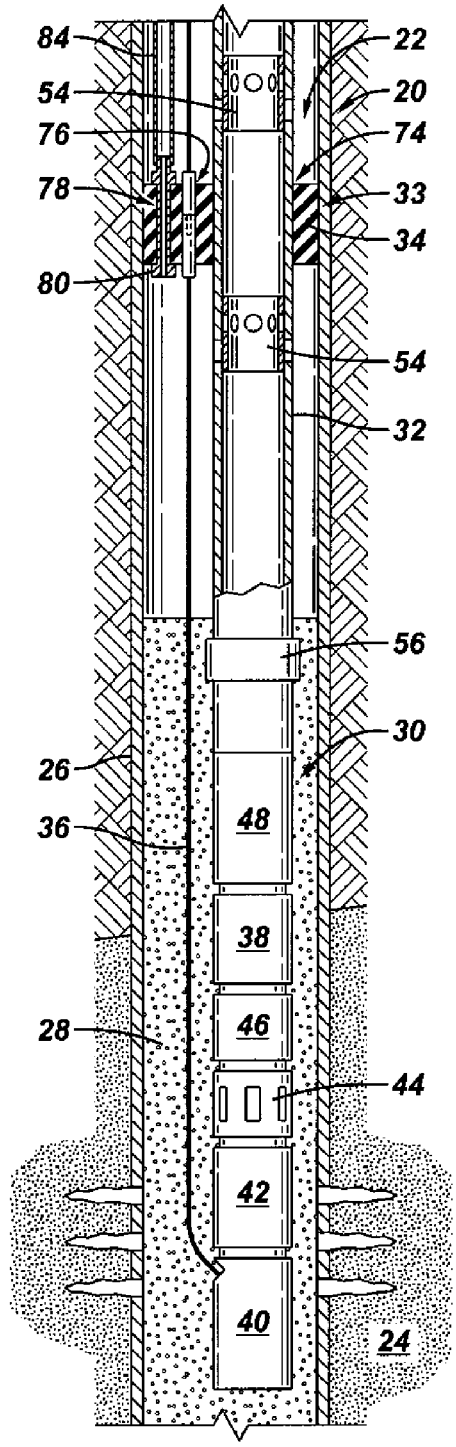
FIG. 6 is a front elevation view similar to that of FIG. 5 but showing an example of another gas removal flow path, according to an embodiment of the present invention.

As illustrated in FIG. 6, the one or more gas vent valves 80 can be coupled to one or more gas vent tubes 84. The gas vent tube 84 provides a specific flow path for containing the produced free gas and directing it to a desired location, e.g. a surface location. In the embodiment illustrated, gas vent tube 84 is positioned along the annulus between tubing 32 and the surrounding casing 26.

Figure 7:
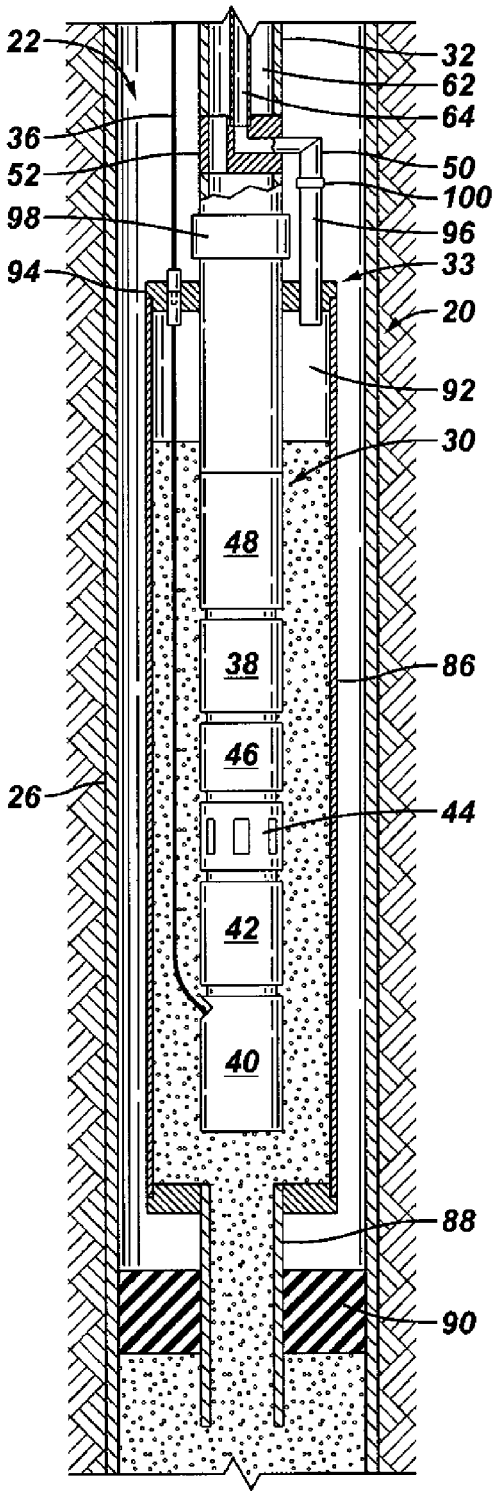
FIG. 7 is a front elevation view of a completion illustrating an alternate embodiment of the present invention.

Another embodiment of completion system 20 is illustrated in FIG. 7. In this embodiment, isolation device 33 comprises a pod assembly 86 that isolates electric submersible pumping system 30 in wellbore 22. A tubing 88 extends downwardly from the pod assembly 86 through a packer 90 to a region of wellbore 22 beneath packer 90. The electric submersible pumping system 30 draws fluid from this region of the wellbore and into pod assembly 86 through tubing 88.

Free gas can collect within pod assembly 86 and rise to an upper region 92 of pod assembly 86, capped by a top 94. As illustrated in FIG. 7, a tubing 96 can be placed in fluid communication with the upper region 92 to enable the outflow of accumulated free gas. For example, tubing 96 can be directed through top 94. Free gas flows upwardly through tubing 96 and into gas inlet 50. Depending on the configuration of landing profile 52, the free gas can be directed along either first flow path 62 or second flow path 64. In this example, a subsurface safety valve 98 is deployed in tubing 32 between landing profile 52 and pod assembly 86. Another subsurface safety valve 100 may be positioned in tubing 96.

Figure 8:
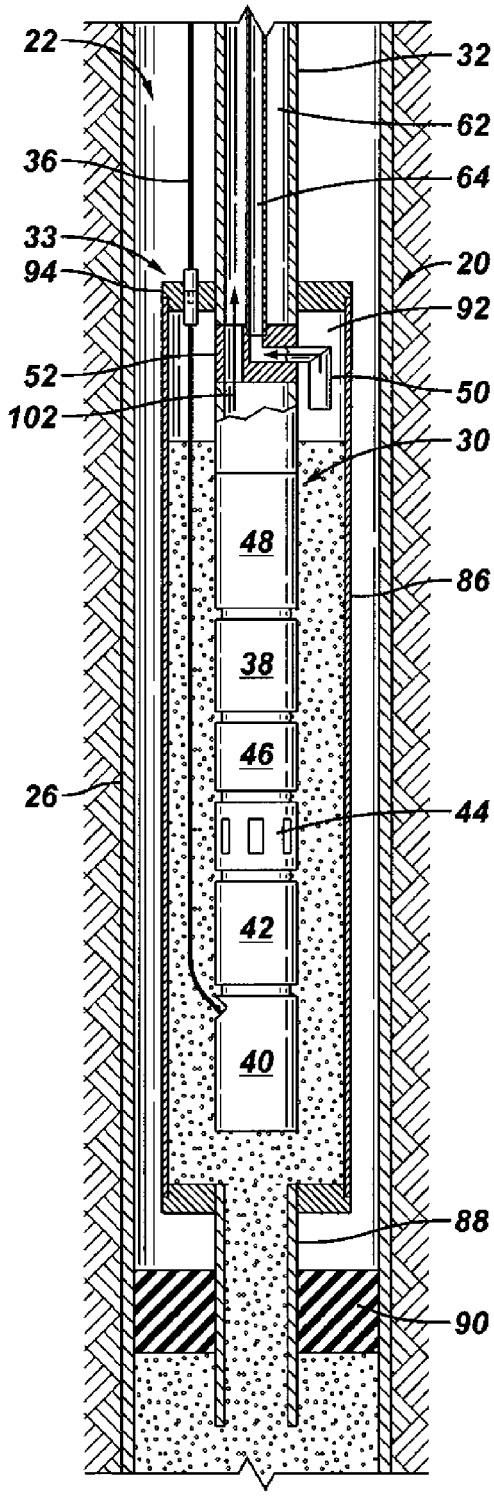
FIG. 8 is a front elevation view similar to that of FIG. 7 but showing an example of another gas removal system, according to an embodiment of the present invention.

An alternate embodiment utilizing pod assembly 86 is illustrated in FIG. 8. In this embodiment, landing profile 52 and gas inlet 50 are positioned within pod assembly 86 below top 94 in upper region 92. Again, the free gas can be directed along first flow path 62 or second flow path 64 depending on the design of landing profile 52. The fluid pumped by electric submersible pumping system 30 is directed along the other of the first and second flow paths. In the embodiment illustrated in FIG. 8, for example, fluid pumped by electric submersible pumping system 30 is directed along first flow path 62, as indicated by arrow 102.

The embodiments described above provide examples of completion systems that utilize an electric submersible pumping system in combination with a gas vent to remove free gas from a specific collection area. The gas vents are particularly useful in venting gas from beneath a packer used to segregate a section of the wellbore. The gas vent embodiments comprise a variety of gas inlets and other types of vents that can remove this accumulated gas before it becomes detrimental to operation of the electric submersible pumping system. It should be noted that many additional or alternate components can be used in constructing the electric submersible pumping system and other aspects of the completion. Additionally, the style of the gas vent, the number of gas vents utilized, and the location of the gas vents can vary from one application to another.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system, comprising:

a well completion having:

an electric submersible pumping system suspended in a wellbore by a tubing through which fluid is produced by the electric submersible pumping system, the electric submersible pumping system separating gas from the fluid upstream of a submersible pump;

a packer through which the tubing extends, the packer causing the gas separated from the fluid to accumulate beneath the packer and external to the tubing; and a gas inlet extending through a side wall of the tubing between the packer and the electric submersible pumping system, the gas inlet comprising a check valve that allows the gas accumulated beneath the packer to flow into the tubing for production with the fluid.

2. The system as recited in claim 1, further comprising a subsurface safety valve positioned in the tubing above the packer.

3. The system as recited in claim 1, wherein the fluid and the gas are produced through the tubing to a surface location.

4. The system as recited in claim 1, wherein the tubing comprises production tubing, and the gas inlet and the check valve are formed in a tubing joint.

5. The system as recited in claim 1, wherein the electric submersible pumping system comprises a submersible motor to drive the submersible pump.

6. The system as recited in claim 5, wherein the electric submersible pumping system comprises a motor protector positioned between the submersible motor and the submersible pump.

7. The system as recited in claim 6, wherein the electric submersible pumping system comprises a gas-oil separator positioned between the submersible motor and the submersible pump.

8. The method as recited in claim 1, further comprising a second tubing located within the tubing to provide a flow path for the gas.

9. The method as recited in claim 1, further comprising a second tubing located within the tubing to provide a flow path for the gas along a space within the tubing and external to the second tubing.

10. A method of forming a well completion, comprising:

suspending an electric submersible pumping system in a wellbore via a tubing through which a fluid is produced by the electric submersible pumping system, the electric submersible pumping system separating gas from the fluid upstream of a submersible pump;

locating a packer about the tubing such that gas separated by the electric submersible pumping system accumulates beneath the packer external to the tubing;

using a gas inlet between the packer and the electric submersible pumping system to direct the separated gas back into the tubing through a side wall of the tubing; and preventing outflow of fluid through the gas inlet with a check valve.

11. The method as recited in claim 10, further comprising positioning a subsurface safety valve in the tubing above the packer.

12. The method as recited in claim 10, further comprising producing the separated gas through the tubing to a surface collection location.

13. The method as recited in claim 10, further comprising locating the gas inlet and the check valve in a tubing joint of the tubing.

14. The method as recited in claim 10, wherein the electric submersible pumping system comprises a submersible motor to drive the submersible pump.

15. The method as recited in claim 10, further comprising routing the separated gas along a flow path within a second tubing located in the tubing.

16. The method as recited in claim 10, further comprising routing the separated gas along a flow path located along a space within the tubing but external to a second tubing positioned within the tubing.

* * * * *